United States Patent [19]

Celez

[11] Patent Number: 4,470,480

[45] Date of Patent: Sep. 11, 1984

[54] MANUALLY OPERATED CONVEYING APPARATUS

[76] Inventor: Remy B. Celez, 9112 W. Fort St., Detroit, Mich. 48209

[21] Appl. No.: 370,665

[22] Filed: Apr. 22, 1982

[51] Int. Cl.[3] ..... A62B 1/20

[52] U.S. Cl. ..... 182/5; 182/72

[58] Field of Search ..... 182/5–11, 182/235, 240, 71, 72, 70, 3, 4, 192, 193; 188/65.1, 65.2, 65.3, 65.4

[56] References Cited

U.S. PATENT DOCUMENTS

| | | | |
|---|---|---|---|
| 816,495 | 3/1906 | Moore | 182/3 |
| 876,840 | 1/1908 | Reuter | 182/3 |
| 1,408,273 | 2/1922 | Davis | 188/65.1 |
| 3,542,158 | 11/1970 | Arnold | 182/5 |
| 4,157,127 | 6/1979 | Katsube | 182/5 |
| 4,191,275 | 3/1980 | Mansfield | 182/3 |

FOREIGN PATENT DOCUMENTS

| | | | |
|---|---|---|---|
| 154282 | 9/1904 | Fed. Rep. of Germany | 188/65.4 |
| 24689 | 9/1912 | Norway | 182/3 |
| 41639 | 7/1925 | Norway | 188/65.2 |
| 1387 | 1/1905 | United Kingdom | 182/3 |

*Primary Examiner*—Reinaldo P. Machado
*Assistant Examiner*—Alvin Chin-Shue

[57] ABSTRACT

This manually operated conveying apparatus for lowering loads is easy to operate, light in weight and most of all it is safe for use.

The apparatus has a rope made into a big loop. It is supported by a shaft with a roller inside the frame. When a load is applied to said rope it produced tension that causes the shaft housings to swing in the direction going with the load and the shafts that are fixed to the shaft housings pressed said rope against the rollers. These pressures tend to hold the rope and stop the load from going down but as the weight of the load exceeds this pressures the load goes down producing another sets of forces, the forces of friction between the rope and the rollers, between the shaft and the rope and between the roller and the shafts. The combined forces produced by the pressures and the frictions are going in the opposite direction that tend to hold and stop the load from going down. These combined functions of the elements inside the frame such as the shafts, the shaft housings and the rollers to hold the rope, enable the apparatus to reduce the weight of the load to the minimum that made it easy to control and lower the load.

1 Claim, 22 Drawing Figures

MANUALLY OPERATED CONVEYING APPARATUS

FIELD OF INVENTION

This invention relates to a manually operated conveying apparatus that can be used to carry, support, and control the load while being lowered.

BACKGROUND OF INVENTION

The invention disclosed herein is an apparatus, simple in construction, easy to operate, light in weight and most of all it is safe to use. This apparatus can be use in many ways, since it is manually operated it can be use indoor and outdoor. In industries it can be use as a manually operated conveyor to lower loads. But this invention is particularly useful as a life saving apparatus.

Each year an unnecessary number of people either die or severely injured due to burns, smoke inhalation, falling down the stairs and sometimes death caused by jumping from a building or structure on fire. These injuries and deaths were caused by long exposure to fire because of lack of a life saving equipment to provide an immediate means of rescuing a person or a means of escape of a person.

As a life saving apparatus it is a means to rescue or escape of a person from a building or structure on fire where escape through stairs and elevators are impossible. It can also be use to bring down an injured person from high places such as a cliff or a mountain to a place where help and medical assistance can be immediately administer. This life saving apparatus is well adapted for use as mentioned above in a rescue and escape operation.

OBJECTS

Accordingly, it is an object of this invention to provide a life saving apparatus for an immediate means of rescue or a means of escape of a person from possible death or injury.

Further object of my invention is to provide a manually operated conveying apparatus for lowering loads.

DRAWINGS

Further objects of my invention will become apparent from the following detailed descriptions together with the accompanying drawings wherein:

FIG. 1 is a partial view of the apparatus illustrating the embodiment of the invention in a reduced scale;

FIG. 2 is a section on the line 1—1 of FIG. 3;

FIG. 3 is a top plan view of FIG. 1;

FIG. 4 is a section on the line 1—1 of FIG. 1;

FIG. 5 is a section on the line 2—2 of FIG. 3;

FIG. 6 is a view similar to FIG. 5 but showing different position of the internal parts;

FIG. 7 is a section similar to FIG. 6 but showing the forces of frictions;

FIG. 8 shows the inside and outside diameter of the rollers or the shafts;

FIG. 9 shows the inside and the outside width of the frame or the shaft housing;

FIG. 10 is an enlarged detail of a closed hook 28;

FIG. 11 is a partial view of the apparatus showing eyebolt 23, lead rope 3, the mounting of box 26 in the carved out hole of the wall and also shows the floor;

FIG. 12 is a view showing an alternate mounting of box 26 on the wall, and also shows the floor;

FIG. 13 is a perspective view of box 26;

FIG. 14 is a partial view of the apparatus showing lead rope 3 wound around a support and fastened by snap hook 27;

FIG. 15 is an enlarged detail showing snap hook 27 tied to one end of lead rope 3;

FIG. 16 is a perspective view of the shaft housing;

FIG. 17 is a fragmentary view of the shafts and the roller;

FIG. 18 is a fragmentary view of handle 2, roller 6, shaft 5, and a nut 29;

FIG. 19 is a side elevation view of handle 2;

FIG. 20 is an enlarged detail of eyebolt 23;

FIG. 21 is a partial view showing a rescue of an injured person using the apparatus; and FIG. 22 is a partial view showing a person escaping from danger using the apparatus.

DESCRIPTION OF THE DRAWINGS

The frame 1, the shaft housings 7,8 and 9, the rollers 6, 16,17 and 18, the shafts 10,11,12,13,14,15,19,20 and 21 are all made of a lightweight metal tubing especially aluminum. All the rollers have similar diameter. The inside diameter of the rollers are slightly bigger than the outside diameter of the shafts so that it can move and rotate.

Figure 11:
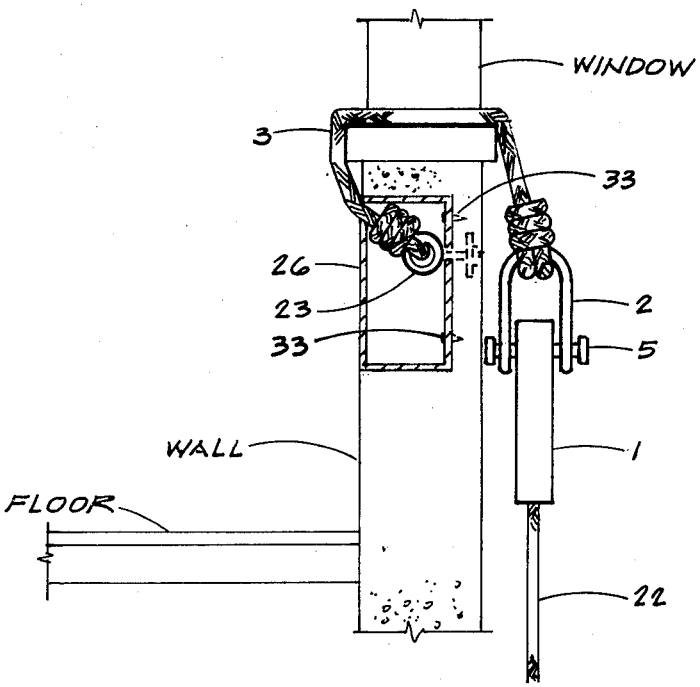
Figure 14:
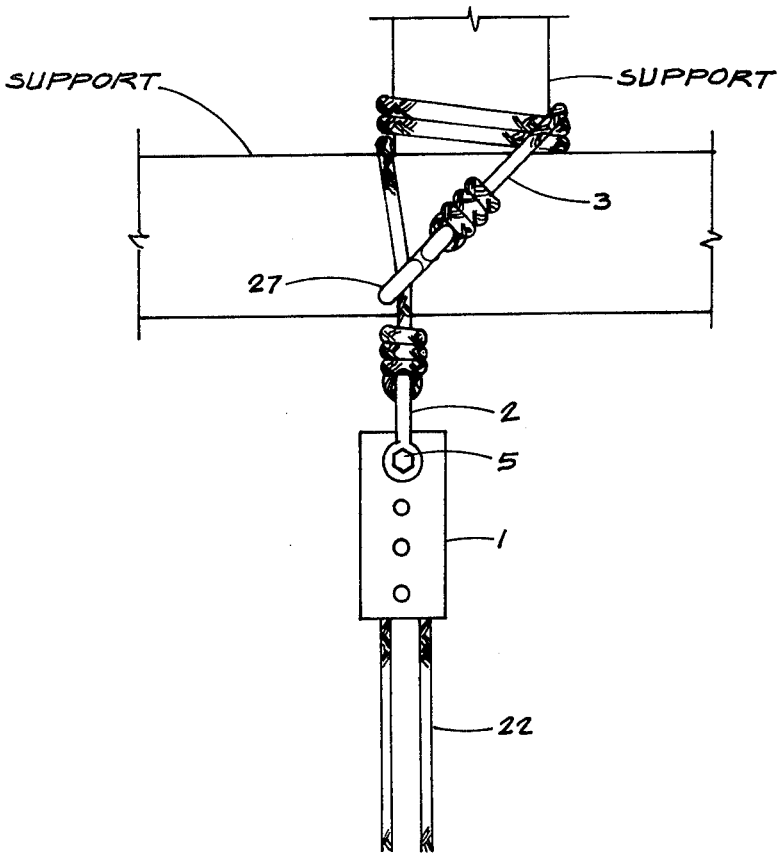
Figure 15:
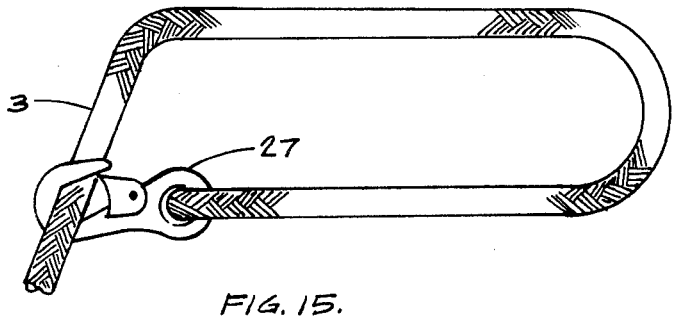
Figure 20:
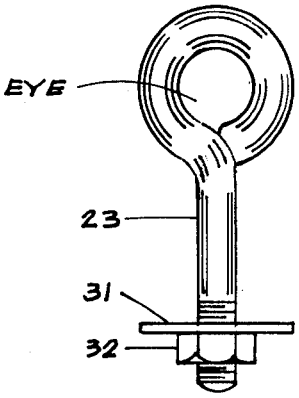

The lead rope 3 is made of a strong rope material, one end is tied to the eye of an eyebolt 23, FIGS. 11 and 20, or tied to a snap hook 27, FIGS. 14 and 15, and the other end of said lead rope is tied to handle 2 as shown on the drawings.

Figure 18:
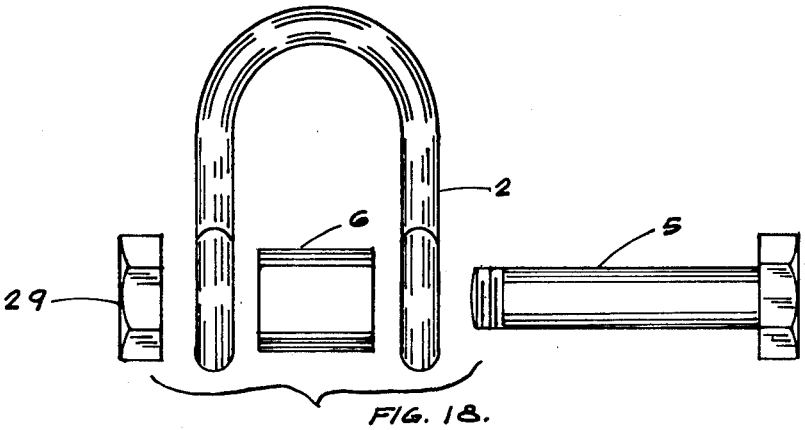
Figure 19:
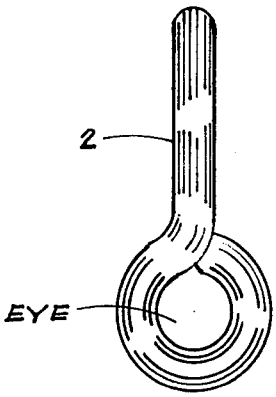

The handle 2, as shown on the drawings, is made of a strong steel rods bent in a U-shape with an eye on both ends facing each other; see FIGS. 18 and 19.

Figure 2:
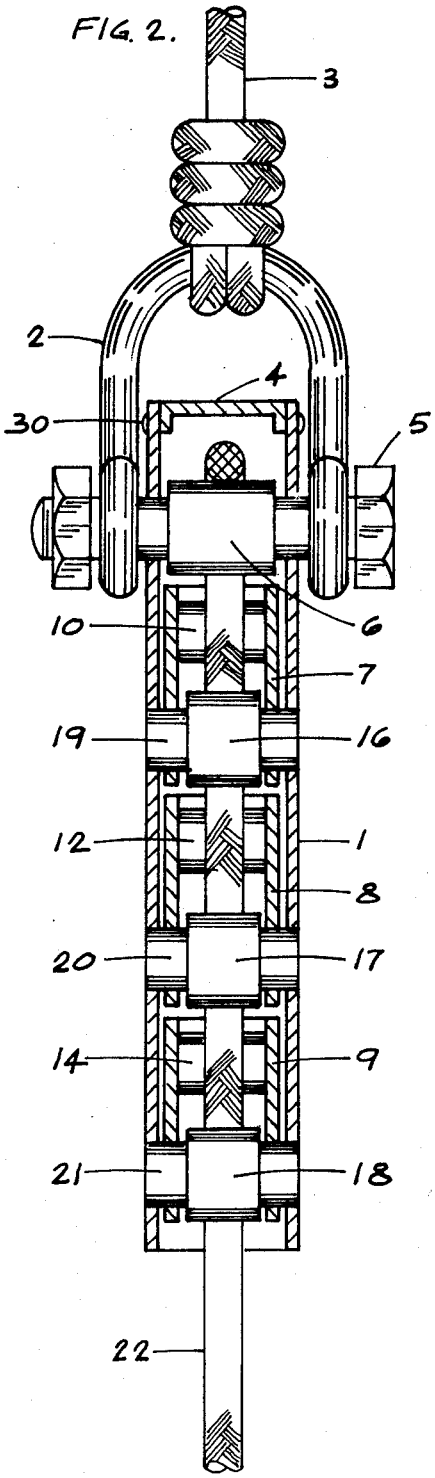
Figure 5:
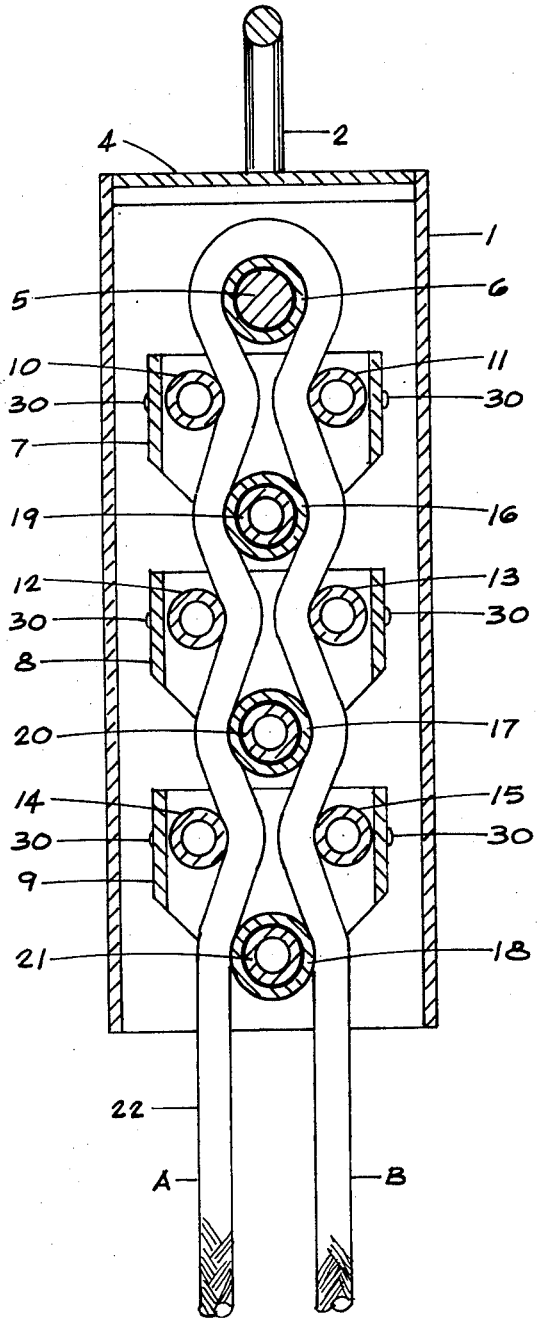

The frame 1, as shown on the drawings, is made of a rectangular tubing having a series of holes equally spaced at the center of both sides facing each other; see FIGS. 2 and 5.

Figure 16:
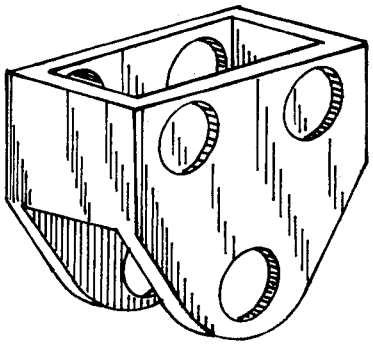

The shaft housings 7,8 and 9, FIGS. 2,5 and 16 are similar in size and shape and are made of a rectangular tubing with three holes on both sides facing each other, two of said holes are on the top near the sides and the third hole is at the bottom and at the center, said shaft housings are loosely connected to the shafts 19,20 and 21 so that it can move and swing either side.

The rollers 6,16,17 and 18, FIGS. 2 and 5 are made of a round metal tubing. The length of the roller 6 is slightly shorter than the inside width of the frame 1 so that it can move and rotate, see FIG. 9. The rollers 16,17 and 18 are slightly shorter than the inside width of the shaft housings, see FIG. 9.

The shaft 5, as shown on the drawings, is made of a stong steel bolt with a nut 29 and connects the frame 1 and the roller 6 to handle 2. It is inserted through the eyes of handle 2, see FIGS. 18 and 19, through the holes on the top of the frame 1 and through the roller 6, said handle 2 and said frame 1 are loosely connected to said shaft so that it can move and swing either side.

Figure 17:
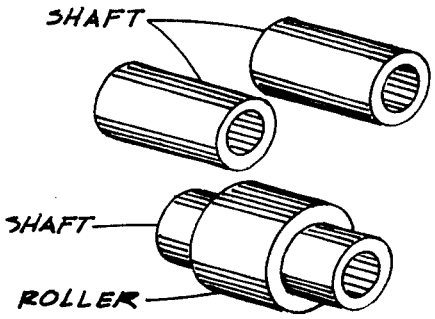

The shafts 10,11,12,13,14 and 15, FIGS. 2 and 5, are made of a round metal tubing. The length is equal to the outside width of the shaft housing, see FIG. 9, and both ends of the shafts are inserted and fixed to the holes at the top of the shaft housings by the nut 29. FIG. 17 shows the similar arrangement of the shafts and the roller in the shaft housing.

Figure 9:
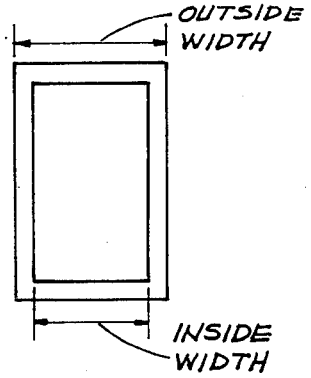
Figure 10:
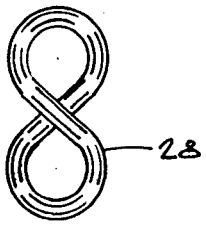

The shafts 19,20 and 21, FIGS. 2 and 5, are made of a round metal tubing and the length is equal to the outside width of frame 1, see FIG. 9, and supports the shaft housings and the rollers 16,17 and 18, and also connect the shaft housings and the rollers to frame 1. These shafts are inserted through the holes of frame 1, through the holes at the bottom of the shaft housings and through the rollers and both ends of said shafts are fixed to the holes of frame 1.

The shafts from FIG. 5 form three columns. The column of shafts with rollers are between the columns of shafts that are fixed to the shaft housings.

Figure 1:
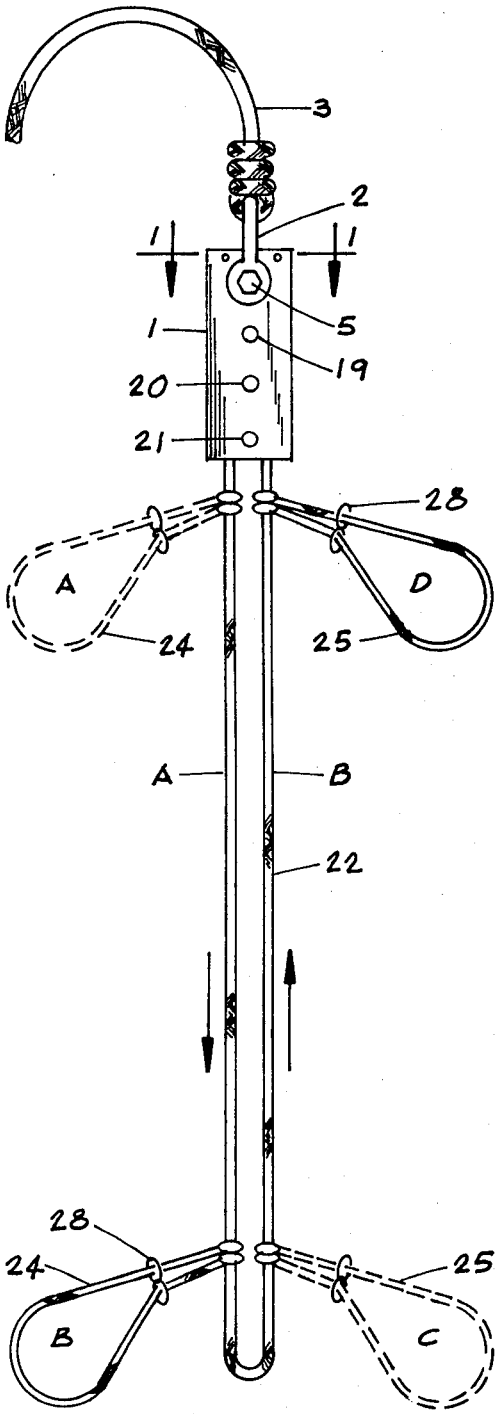
FIG. 1 is a partial embodiment of the apparatus showing the frame 1, the handle 2, the rope 22 and a partially shown lead rope 3.

The rope 22, FIGS. 1,21 and 22, is a big loop, its length varies according to the height at which it is use, said rope 22 has two sides, A and B. Each side has a smaller loop, loop 24 and loop 25, and each loop is inserted through a closed hook 28. Loop 24 and loop 25 are big enough to be strapped around the body of a person or around the load, and are spaced halfway apart around rope 22. If loop 24 (in dotted lines FIG. 1) is at the top just below frame 1, loop 25 (in dotted lines FIG. 1) is at the bottom.

The rope 22, FIGS. 2 and 5, is passing between the columns of shafts and goes around the column of shafts with rollers.

Figure 3:
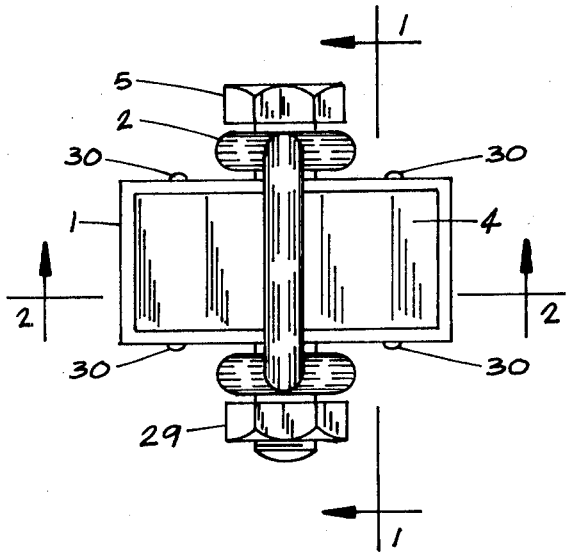

The cover 4, FIGS. 2,3 and 5, is made of an angular shape lightweight metal especially aluminum, it is fixed to frame 1 by the screws 30.

The eyebolt 23, FIGS. 11 and 20, is made of a strong steel rod, said eyebolt is tied to one end of lead rope 3, the end is inserted through the holes of box 26 and the wall and fixed to the wall by a washer 31 and a nut 32.

Figure 12:
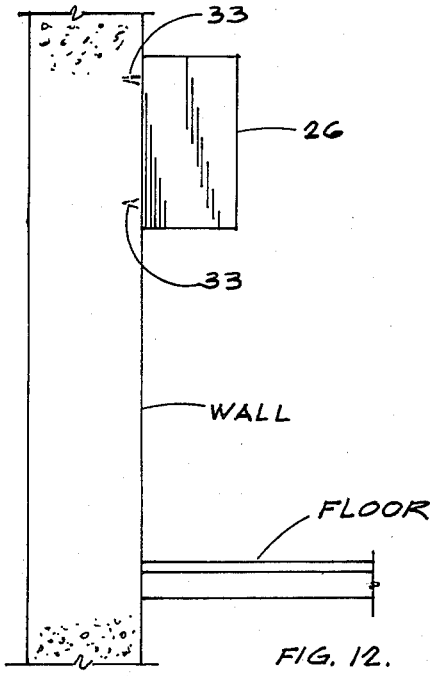
Figure 13:
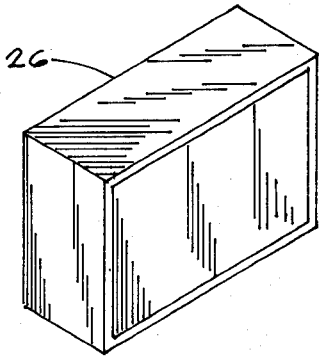

The box 26, FIGS. 11,12 and 13, is made of a sheet metal that is big enough to contain the apparatus, it can be mounted in a carved out hole of the building structure especially the wall, see FIG. 11, or on the wall, see FIG. 12. The box 26 is mounted near the wall exit especially the window at a convenient height from the floor so that everybody can reach and use it, said box is fixed to the wall by the screws 33.

OPERATIONS

This manually operated conveying apparatus when use as a life saving apparatus is kept inside the box 26. When there is a fire or an emergency the apparatus is taken out and then lower outside the window and let it hanged as shown on FIGS. 1 and 11. Loop 24 which is at the top (in dotted lines FIG. 1) is strapped around the body of a person as on FIGS. 21 and 22. The loop is tightened to prevent the person from falling by pushing the closed hook 28 towards the body, then the person crawls out of the window holding the rope 22, see FIG. 22, to control the rope as he goes down. If the person is injured he must be helped getting out of the window and then lower down by a helper, see FIG. 21. In both cases whether a person is injured or not he must be helped to prevent further injuries.

The box 26, see FIGS. 11,12 and 13, is where the apparatus is kept when it is not use. It is mounted in a carved out hole of the building structure especially the wall or on the wall and fixed to the wall by a fixing element like a screw 33.

The eyebolt 23, see FIGS. 11 and 20, supports the lead rope 3, it is inserted through the hole of box 26 and fixed to the hole of the wall by a fixing element like nut 32 and washer 31.

The lead rope 3, FIGS. 1,2,11 and 14, supports the handle 2 and connects the eyebolt 23 to the handle 2.

The handle 2, FIGS. 1,2,5,11 and 14, supports the frame 1, said handle is securely tied to one end of lead rope 3.

Figure 4:
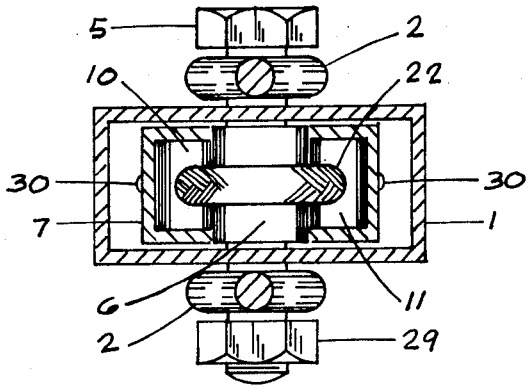

The shaft 5 connects the handle 2 to frame 1 and also supports the roller 6 and the rope 22, see FIGS. 2,4 and 5, and a tightening element like nut 29 prevent the frame 1 and the handle 2 to loosen from shaft 5.

The frame 1 also serves as a casing for the shafts, the shaft housings and the rollers and also supports the shafts 19,20 and 21, see FIGS. 2 and 5.

The shafts 19,20 and 21, FIGS. 2 and 5, supports the rollers 16,17 and 18 and the shaft housings and also connects the rollers and the shaft housings to frame 1 and both ends of said shafts are fixed to the holes of frame 1.

The shaft housings 7,8 and 9, FIGS. 2,5 and 16, supports the shafts 10,11,12,13,14 and 15 and are loosely connected to the shafts 19,20 and 21 so that it can move and swing either side.

Figure 6:
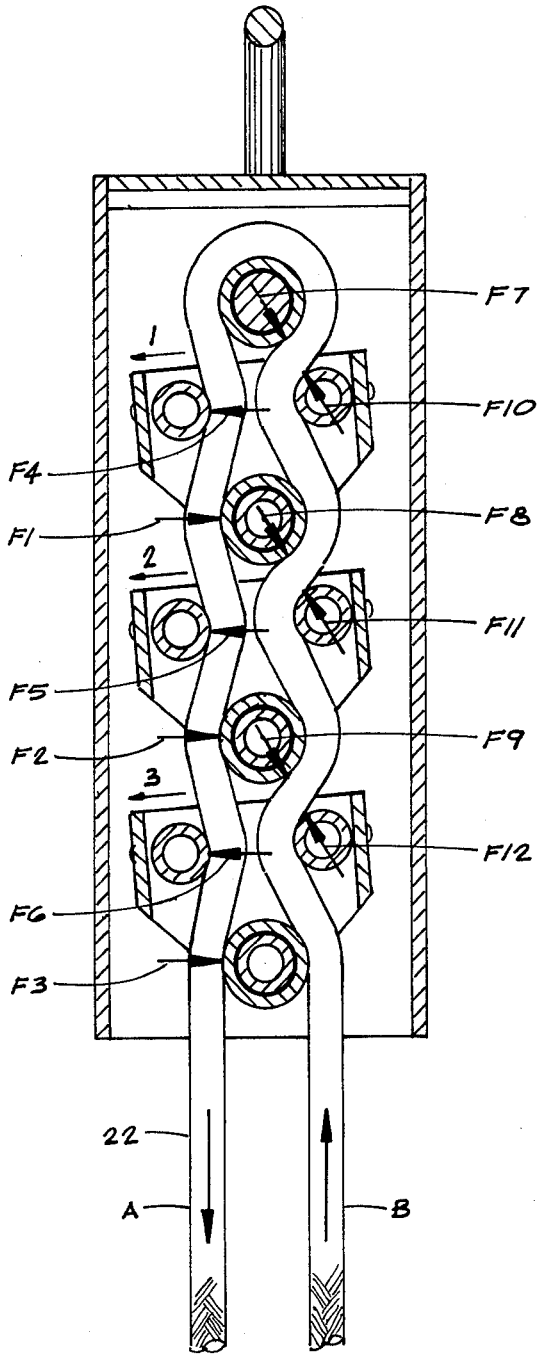

The shafts 10,11,12,13,14 and 15, FIGS. 2,5 and 6, are to press the rope 22 against the roller 6,16 and 17 to produce the forces that tends to hole and stop the load from going down and the forces of friction between the shafts and the rope, between the rope and the rollers and between the rollers and the shafts. These forces reduced the weight of the load so that the load can easily be controlled. The rollers rotate and the rope 22 will go down when the weight of the load exceeds the pressure and the forces produced by friction.

The rope 22, FIGS. 1,21 and 22, supports, controls and lowers the load. The load is controlled by pulling either side of rope 22. The loops 24 and 25 carry and hold the load.

The cover 4, FIGS. 2,3 and 5, pervent hard objects to get inside of frame 1 that might hinder the operation of the apparatus. Said cover is fixed to frame 1 by a fixing element like the screws 30.

The apparatus is made portable to be use at any location indoor and outdoor by using a supporting and fastening element like snap hook 27, FIGS. 14 and 15, which is tied securely to one end of the lead rope 3, then said lead rope 3 is wound around the support, see FIG. 14, and said snap hook 27 support and fastened said lead rope 3 to said support. The sequence of operation is similar to the apparatus fixed to the wall as described above.

In FIG. 1 A is the position of loop 24 (in dotted lines) and C is the position of loop 25 (in dotted lines) when there is no load. Since rope 22 is a big loop, when load is applied to loop 24 at position A it goes down (see direction of arrow) unitil it reached position B. At the same time loop 15 at position C goes up and reached the top at position D.

If the load is taken out from loop 24 at position B, loop 25 at position D is ready to take up load immediately. If load is applied to loop 25 at position D, said loop will go down, at the same time loop 24 goes up. This alternating up and down motion of loop 24 and loop 25 shows how fast the apparatus can lower the load.

One important aspect of the apparatus is its ability to control the load by reducing the weight through the functions of its internal parts, the shafts, the shaft housings and the rollers.

FIG. 5 shows the position of the shaft housings when there is no load. Its centerline is in line vertically with the centerline of the shafts 5,19,20 and 21. Side A and side B of rope 22 are symmetrical in shape with each other.

Figure 7:
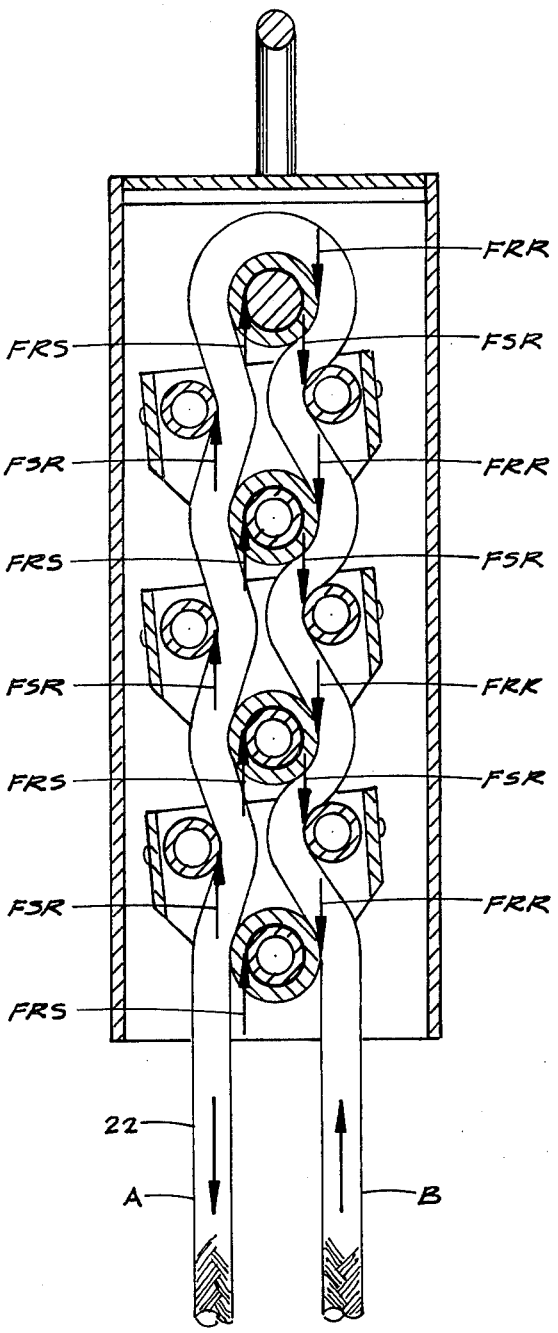
Figure 8:
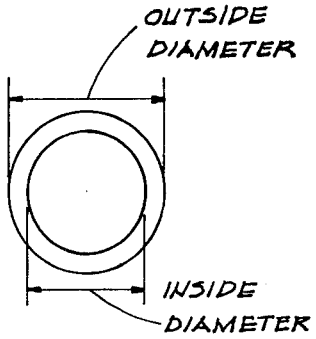

FIG. 6 shows when load is applied to side A of rope 22, said rope straightened a little bit due to the tension created by the weight of the load and produced two sets of forces acting opposite each other. Forces F1, F2 and F3 are pushing shafts 19,20 and 21. Since the shaft housings 7,8 and 9 are loosely connected to the shafts 19,20 and 21 said shaft housings swing due to the forces F4,F5 and F6 (see direction arrows 1,2 and 3). At side B of rope 22 when the shaft housings swing the shafts 11,13 and 15 pressed said rope against the rollers 6,16 and 17. These pressures produced sets of forces opposing each other that tend to hold said rope, forces F7,F8 and F9 against the forces F10,F11 and F12. As the weight of the load pulls said rope the rollers rotate in the direction going with the load and said rope goes down creating forces due to friction, see FIG. 7, frictions between the rope and the rollers (FRR), frictions between the shafts and the rope (FSR) and frictions between the rollers and the shafts (FRS). All the forces and the forces of frictions described above are going in the opposite direction that tend to stop and hold said rope from going down.

An experiment was conducted to show how the apparatus can control the load by weighing loads of different weights as shown in the table with the use of a spring scale.

Below is the table showing the tabulated result in the experiment conducted by the use of the apparatus described above.

TABLE

| Weight of the loads applied (in pounds) | Forces registered by the scale (in pounds) | Weight of the loads controlled by the apparatus (in pounds) |
|---|---|---|
| 100 | 9 | 91 |
| 150 | 17 | 133 |
| 200 | 30 | 170 |
| 250 | 38 | 212 |
| 300 | 41 | 259 |
| 350 | 47 | 303 |
| 400 | 52 | 348 |

The result in the table shows how efficient the apparatus in controlling the load. For example: A load weighing 400 pounds registered 52 pounds on the spring scale, therefore if we subtract 52 pounds from 400 pounds the remainder is 348 pounds. The remainder of 348 pounds is the weight controlled by the apparatus and the load registered by the scale is the force that will be applied to control the load.

Although the foregoing includes a description of the best mode contemplated for carrying out the invention, various modifications are possible, for example:

1. By adding a set or sets of the shafts, the shaft housings and the rollers to control heavier loads.

2. By taking out a set or sets of the shafts, the shaft housings and the rollers to control lighter loads.

3. By inverting the shaft housing will give similar result to the one shown on FIG. 5.

4. By decreasing the distances between the shafts 5,19, 20 and 21 to control heavier loads.

5. By increasing the distances between the shafts 5,19, 20 and 21 to control lighter loads.

As various modification could be made without departing from the scope of the invention in the constructions herein described and illustrated, it is intended that all matter contained in the forgoing description or shown in the accompanying drawings shall be interpreted as illustrative rather than limiting.

What is claimed is:

1. A manually operated conveying apparatus menas for lowering loads from high rise buildings or structure or high places comprising, a handle, said handle is a U-shape rod having an eye on both ends, a bolt with a nut at one end, a frame, said frmae is a rectangular tubing having holes equally spaced along the center of two sides facing each other, a rope, round shafts, round tubing rollers and shaft housings, said shaft housings are rectangular tubing having holes on two sides facing each other, each of the shaft housing supporting two shafts pressing the rope against the rollers, the shaft housing holes fixing both ends of the shafts to the shaft housing, the bolt means connecting the handle to the frame is inserted through the eyes of the handle, through the holes of the frame and through a roller inside the frame, the nut locking the handle to the bolt, inside the frame are said shaft housings and the rollers, and other shaft means supporting each of the shaft housing and the other rollers to the frame through the holes of the shaft housing and through the rollers, the holes of the frame fixing both ends of the other shaft means to the frame, the rope is passed between the columns of shafts and shafts with rollers, a cover is fixed on the frame, the rope means supporting, controlling and lowering the load is a big loop, its length varies according to the height at which it is to be used, and is provided with two smaller loops means for carrying and holding the load, and are spaced halfway around its length, one of the smaller loop is at the top just below the frame and the other is at the bottom of the rope, one end of a lead rope means supporting the apparatus is tied to the handle and the other end is tied to a supporting element means fixed to a building wall or structure, the apparatus can be made portable for use at any location indoor or outdoor by means of tying one end of the lead rope to the handle and the other end to a supporting element means, when the apparatus is used during fire or emergency, the apparatus is lowered outside a window and the smaller loop at the top is strapped around the body of a person, then the person crawls out of the window and controls the descent by holding the other side of the rope, as the person goes down the other smaller loop at the bottom of the rope goes to the top to take down another person.

* * * * *